United States Patent [19]

Berube et al.

[11] Patent Number: 4,924,756

[45] Date of Patent: May 15, 1990

[54] BELLOWS CORE AND METHOD AND APPARATUS FOR FABRICATION THEREOF

[75] Inventors: Donald N. Berube, Tiverton; Amitava Datta, East Greenwich, both of R.I.

[73] Assignee: EG&G Sealol, Inc., Cranston, R.I.

[21] Appl. No.: 194,910

[22] Filed: May 17, 1988

[51] Int. Cl.[5] ..... F01B 19/00

[52] U.S. Cl. ..... 92/45; 92/47; 92/103 M; 228/182; 228/212

[58] Field of Search ..... 228/182, 212, 44.3; 29/454, 238, DIG. 4; 92/103 M, 104, 97, 34, 45, 47

[56] References Cited

U.S. PATENT DOCUMENTS

| | | | |
|---|---|---|---|
| 1,717,196 | 6/1929 | Emmet | 29/454 |
| 2,117,106 | 5/1938 | Silliman | 92/47 X |
| 2,174,171 | 9/1939 | Wasson | 92/47 X |
| 2,534,123 | 12/1950 | Hasselhorn | 29/454 X |
| 2,657,074 | 10/1953 | Schwester et al. | 92/34 X |
| 3,100,256 | 8/1963 | Borg | 29/454 X |
| 3,233,632 | 2/1966 | Voitik | 228/182 X |
| 3,482,302 | 12/1969 | Williams | 228/182 X |
| 3,512,244 | 5/1970 | Dunbar | 228/212 X |

FOREIGN PATENT DOCUMENTS

| | | | |
|---|---|---|---|
| 447816 | 4/1948 | Canada | 92/47 |

*Primary Examiner*—Edward K. Look

*Attorney, Agent, or Firm*—Finnegan, Henderson, Farabow, Garrett & Dunner

[57] ABSTRACT

A metal bellows core is comprised of a plurality of resilient annular metal diaphragm members which are brazed together. A method for fabricating a metal bellows core is comprised of steps including brazing the metal diaphragm members together simultaneously in a furnace. An apparatus for fabricating a metal bellows core is comprised of means for positioning, coaxially aligning and compressing the diaphragm members and brazing filler material members for brazing.

5 Claims, 4 Drawing Sheets

BELLOWS CORE AND METHOD AND APPARATUS FOR FABRICATION THEREOF

BACKGROUND OF THE INVENTION

The present invention relates to a metal bellows core and to a method of fabricating a metal bellows core.

Metal bellows assemblies, typically consisting of a bellows core joined to end fittings or component mating parts, are useful in applications where media, extreme temperature, pressure or radiation problems preclude the use of traditional elastomeric devices. Applications for metal bellows assemblies include shaft seals, expansion joints, flexible vacuum connections, pneumatic controllers, sensors, actuators and switches. Conventional metal bellows cores are formed in one piece or are fabricated by welding together adjoining annular metal diaphragms. Typically, the bellows core is joined to end fittings or component mating parts by soldering, brazing or welding.

In fabricating a conventional metal bellows core by welding together a series of annular diaphragms or plates, numerous individualized joining steps are typically required. This inability to form all joints simultaneously increases costs and job lead-time. In addition, in a welded metal bellows, the thickness of weld-bead or "nugget" which is formed at the edge joints will exceed the combined thickness of the plates or surfaces being joined. Since the abutting of the weld-beads of adjacent joints will prevent full compression of the bellows core, complete "nesting" and broad-based support of the adjacent diaphragm members upon collapse of the bellows core will not be possible.

SUMMARY OF THE INVENTION

An object of the present invention is to provide a rugged and fluid-tight brazed metal bellows core which is relatively easy and inexpensive to manufacture.

Another object is to provide a strong brazed metal bellows core which permits substantially complete nesting and broad-based support of the diaphragm members upon compression of the bellows core, and is particularly well suited to high pressure applications.

Another object is to provide a simple and relatively inexpensive method for quickly, easily, and accurately fabricating a metal bellows core.

To achieve the foregoing objects, and in accordance with the invention as embodied and broadly described herein, a metal bellows core is provided comprising a plurality of resilient annular metal diaphragm members, each member having an inner flange portion with an opening defined by an inner perimetrical edge of the inner flange portion, an outer flange portion with an outer perimetrical edge defined by the outer perimetrical edge of the outer flange portion, and a flexible annulus portion extending between the inner and outer flange portions. The diaphragm members are aligned and positioned to form alternating pairs of adjacent inner flange portions and adjacent outer flange portions. Brazing material is interposed between and joins together the alternating pairs of adjacent inner and outer flange portions.

To achieve these objects, and in accordance with another aspect of the invention as embodied and broadly described herein, a method of fabricating a metal bellows core is provided, comprising the steps of: positioning a plurality of resilient annular metal diaphragm members having an inner flange portion and an outer flange portion to form alternating pairs of adjacent inner flange portions and adjacent outer flange portions; interposing brazing material between the pairs of adjacent inner and outer flange portions; and, heating the diaphragm members and the brazing material to braze and join together the pairs of adjacent inner and outer flange portions.

To further achieve these objects, and in accordance with another aspect of the invention as embodied and broadly described herein, an apparatus is provided for fabricating a brazed metal bellows core from a plurality of resilient annular metal diaphragm members and a plurality of annular brazing filler material members for brazing the diaphragm members together, comprising means for positioning the diaphragm members and brazing material members in a stacked formation with the brazing material members interposed between adjacent diaphragm members; means for coaxially aligning the stacked diaphragm members and brazing material members; and means for axially compressing the stacked and coaxially aligned diaphragm members and brazing material members for providing intimate contact therebetween and for maintaining the members in the stacked and coaxially aligned position during brazing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings which are incorporated in and constitute a part of the specification, illustrate a preferred embodiment of the invention and, together with the summary of the invention given above and the detailed description of the preferred embodiment given below, serve to explain the principles of the invention.

DESCRIPTION OF THE PREFERRED EMBODIMENT

Figure 1:
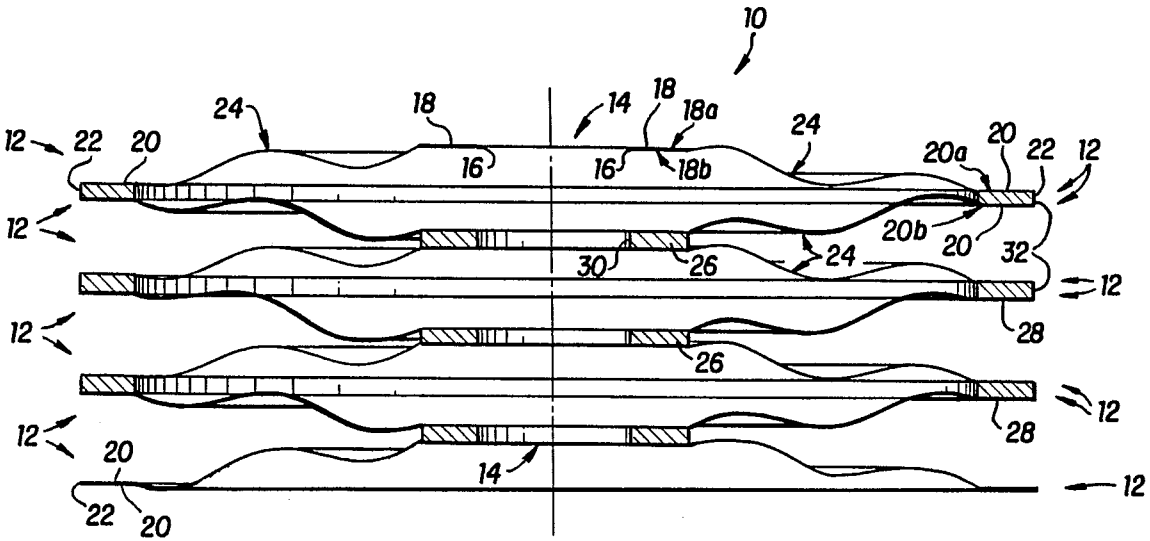
FIG. 1 is a sectional view of a portion of a metal bellows core incorporating the teachings of the present invention.

Reference will now be made in detail to the present preferred embodiment as illustrated in the accompanying drawings wherein like reference numerals refer to like parts.

In accordance with the invention, there is provided a bellows core comprising a plurality of resilient annular metal diaphragm members, each member having an inner flange portion with an opening defined by an inner perimetrical edge of an inner flange portion, an outer flange portion with an outer perimetrical edge defined by the outer perimetrical edge of the outer flange portion, and a flexible annulus portion extending between the inner and outer flange portions.

Figure 2:
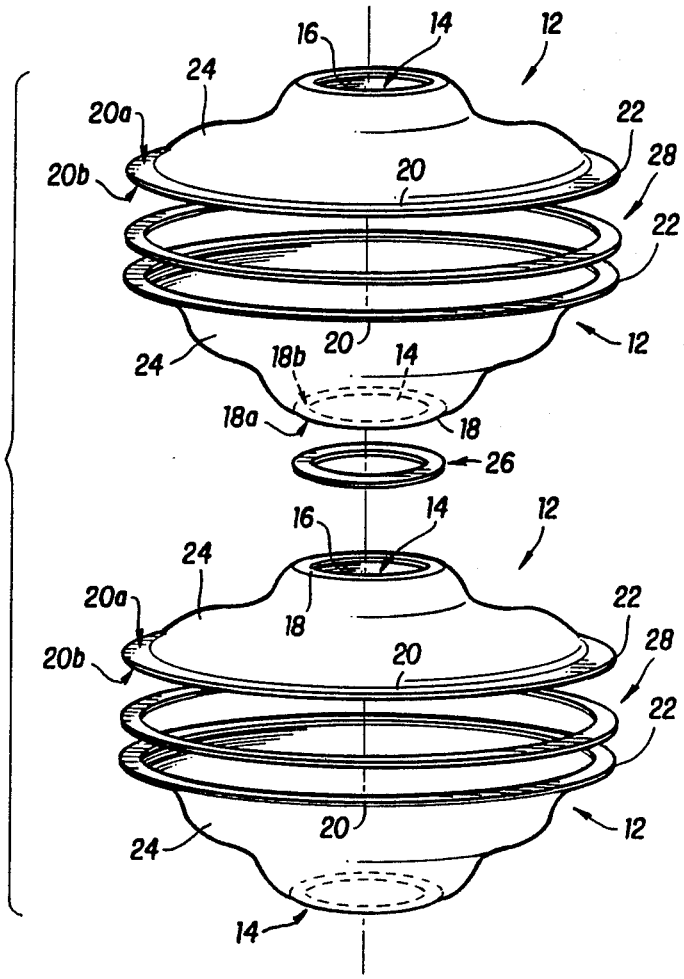
FIG. 2 is an exploded view in perspective of the present preferred embodiment, showing in expanded form the position of the diaphragm members and the inner and outer washers prior to brazing as shown in FIG. 3.

A preferred embodiment of the brazed metal bellows core is shown in FIG. 1 and is represented generally by the numeral 10. As embodied herein, bellows core 10 is comprised of resilient annular diaphragms 12 arranged as illustrated in FIGS. 1 and 2. Each diaphragm member has an opening 14 defined by an inner perimetrical edge 16 of an inner flange 18. Flange 18 is radially inward of an outer flange 20. The outer perimetrical edge of diaphragm 10 is defined by an outer perimetrical edge 22 of outer flange 20. Flexible annulus 24 is intermediate flanges 18, 20. When bellows core 10 is extended or compressed, bellows action is provided due to flexure of each diaphragm 12 at the respective junctures of annulus 24 with flanges 18, 20.

Preferably, diaphragms 12 and flanges 18, 20 are circular and opening 14 is central to flange 20. Diaphragms 12 preferably are similarly dimensioned and configured, have a similar uniform thickness, and are aligned coaxially. The base metal for diaphragms 12 is sufficiently resilient to permit repeated flexure of the diaphragms 12, especially the juncture of annulus 24 and flanges 18, 20, to prevent potential leakage of working fluid due to failures caused by metal fatigue or other stress induced failures during the design lifetime of bellows core 10. Flange 18 is preferably perpendicular to the longitudinal axis of bellows core 10, and flange 20 is parallel to flange 18. Diaphragms 12 preferably are formed so that when bellows core 10 is at rest or in the unflexed state, each diaphragm 12 is biased in the direction of the axially extended state of bellows core 10, wherein flanges 18, 20 are axially displaced, and annulus 24 generally forms an acute angle in relation to the longitudinal axis of bellows core 10.

In accordance with the invention, the diaphragm members are aligned and positioned to form alternating pairs of adjacent inner flange portions and adjacent outer flange portions. As embodied herein, each diaphragm 12 is positioned in axially opposed relation to the adjacent diaphragms 12 respectively positioned at opposite ends thereof as best illustrated in FIG. 2. Flanges 18, 20 of adjacent diaphragms 12 are thus mated to form alternately positioned, axially spaced joints defined by pairs of adjoining flanges at radially inner and outer extremes, respectively, of bellows core 10.

In accordance with the invention, brazing material is interposed between and joins together the pairs of adjacent inner and outer flange portions. As shown in FIG. 2, the brazing material is a continuous ring 26, 28 of brazing filler metal interposed between each pair of adjacent flanges 18, 20, respectively, brazing the plurality of diaphragms 12 together to form brazed bellows core 10. Alternatively, a brazing paste may be applied to one side of the inner and outer flanges 18, 20 of diaphragms 12 and dried prior to assembling the diaphragms. In this alternative embodiment, separate rings of brazing filler metal would not be required.

In accordance with the invention, the brazing material is comprised of a continuous ring of brazing filler metal having a width no greater than the width of the flange portions. As embodied herein, rings 26, 28 of brazing filler metal are of uniform thickness and have a width no greater than the width of corresponding flanges 18, 20. The inner diameter of ring 26 coincides with the inner edge 16 of flange 18, and the outer diameter of ring 28 coincides with the outer edge 22 of flange 20. The choice of various design parameters including the dimensions of rings 26, 28 and the width of flanges 18, 20, are chosen empirically and are governed, in part, by the desire to avoid undesirable superfluous wicking of molten filler material away from the joint area due to capillary attraction during brazing.

In accordance with the invention, each annulus portion is similarly dimensioned and configured, and the brazing material is confined between the respective inner perimetrical edges of the inner flange portions and the outer perimetrical edges of the outer flange portions, to permit intimate juxtaposition of the unbrazed surfaces of the adjacent diaphragm members at times when the plurality of diaphragm member is in a collapsed state. As embodied herein, each annulus 24 is similarly dimensioned and configured, and rings 20, 28 of brazing filler metal have widths no greater than flanges 18, 20 and are confined radially outward of inner perimetrical edge 16 and radially inward of outer perimetrical edge 22, respectively. In so doing, the brazing material interposed between a first pair of adjacent flanges 18, 20 cannot come into contact with the brazing material interposed between a second pair of adjacent flanges to thereby prevent the complete collapse of bellows core 10. As a result annuli 24 of adjacent diaphragm members 12 are permitted to be in registry and intimate contact.

Bellows core 10 is thus imbued with maximum strength at times when the bellows core 10 is axially compressed into a collapsed state, since flanges 18, 20 of each diaphragm 12 may be urged into a substantially coplanar engaging relationship forming a broad-based support. This capability of diaphragms 12 to "nest" substantially completely upon compression of bellows core 10 imparts strength, since maximum nesting corresponds to maximum effective radial dimension of the walls of the bellows core 10. Thus, when bellows core 10 is fully nested, the operating load is distributed through the entire span of annuli 24 extending between flanges 18, 20, oriented substantially perpendicular to the axis of bellows core 10.

Preferably, annulus 24 is corrugated as best shown in FIG. 1 to provide resiliency and to increase the overall strength of bellows core 10, particularly in high pressure applications such as encountered in the aircraft industry.

In an actual reduction to practice, a brazed metal bellows core having a nominal operating length (unflexed) of 1.386 inches was fabricated in accordance with the present preferred embodiment of the invention. Diaphragms 12 were composed of AM-350 stainless steel having an outer diameter of 1.937 inches, an inner diameter of 1.437 inches, and a thickness of 0.006 inches; flanges 18, 20 were 0.030 inches in width; and rings 26, 28 (before brazing) were 0.025 inches in width.

In accordance with another aspect of the present invention, a method of fabricating a metal bellows core is provided. The method includes positioning a plurality of resilient annular metal diaphragm members having an inner flange portion and an outer flange portion to form alternating pairs of adjacent inner flange portions and adjacent outer flange portions. As herein embodied and as shown in FIG. 2, the method comprises forming a plurality of diaphragms 12 having a central opening 14 defined by an inner perimetrical edge 16 of inner flange portion 18, an outer flange portion 20 with an outer perimetrical edge 22 and flexible annulus 24, the inner and outer flange portions 18, 20 each having opposite parallel planar surfaces 18*a*, 18*b* and 20*a*, 20*b*, respectively.

The method also includes interposing brazing material between the pairs of adjacent inner and outer flange portions. As shown in FIG. 2, the interposing step includes positioning inner washers 26 and outer washers 28 of brazing material between the pairs of adjacent flange portions. It is preferred that the plurality of inner washers 26 and outer washers 28 of brazing filler material are of uniform thickness. Inner washers 26 have an inner diameter substantially equal to the diameter of opening 14 in diaphragm member 12, and outer washers 28 have an outer diameter substantially equal to the outer diameter of diaphragm members 12. Washers 26, 28 have an annular width no greater than flanged portions 18, 20, respectively.

In fabricating the metal bellows core of the present invention from the formed diaphragm members 12 and the formed inner and outer washers 26, 28 of brazing filler material, and in accordance with the method provided, an apparatus is provided comprising means for positioning the diaphragm members and brazing material members in a stacked formation with the brazing material members interposed between adjacent diaphragm members.

Figure 3:
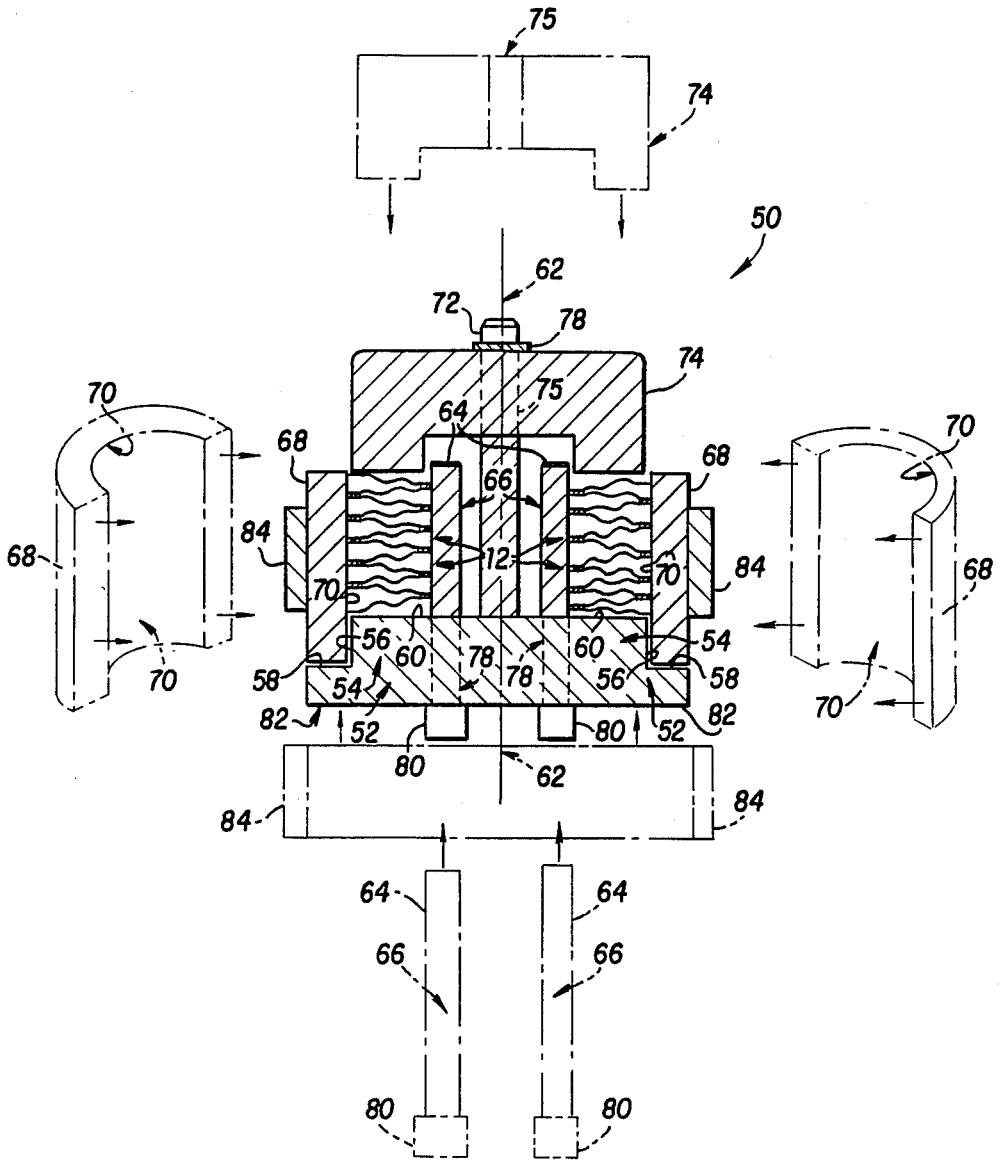
FIG. 3 is a sectional view of a brazing apparatus incorporating the teachings of the present preferred embodiment of the invention (taken along line A—A of FIG. 4), showing in phantom the removed top portion, inner and outer guidemembers, and annular ring.
Figure 4:
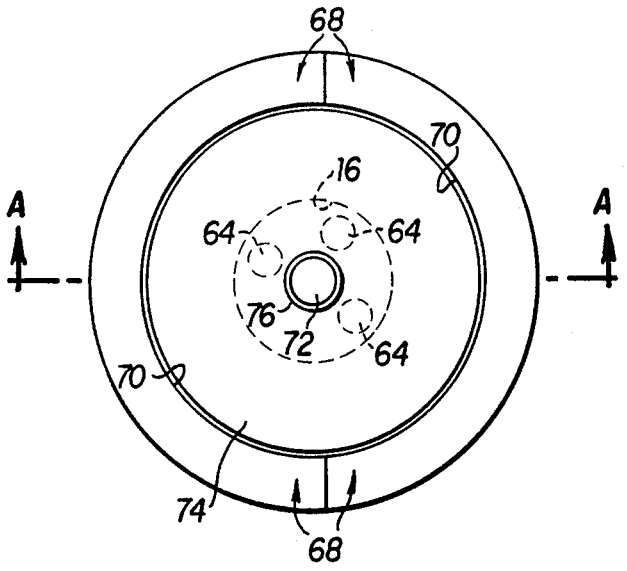
FIG. 4 is a top view of the brazing apparatus shown in FIG. 3, showing in phantom the inner guide members in position for coaxially aligning the diaphragm members and the inner washers for brazing.

Referring to FIGS. 3 and 4, and as herein embodied, the apparatus, generally referred to by the numeral 50, comprises a planar member 52 having a cylindrical portion 54 forming a peripheral surface 56 for defining an inner circular boundary of a first supporting surface 58 with the cylindrical portion having a planar second supporting surface 60 with an outer diameter equal to the outer diameter of diaphragm members 12 and outer washer 26 of brazing material and a central axis 62 for supporting in position thereon a stacked formation of diaphragm members 12 and brazing material members 26 and 28 and any end fittings or mating components (not shown). Each inner washer 26 is interposed between the planar surface 18*a*, 18*b* of the inner flange portion 18 of a respective first diaphragm member 12 and the corresponding facing planar surfaces 18*b*, 18*a* of the inner flange portion 18 of an adjacent second diaphragm member 12. Each outer washer 26 is interposed between the planar surfaces 20*a*, 20*b* of the outer flange portion 20 of the respective first diaphragm member 12 and the corresponding facing planar surface 20*b*, 20*a* of the outer flange portion 20 of a third adjacent diaphragm member 12.

In accordance with the present invention, the apparatus also comprises means for coaxially aligning the stacked diaphragm members. As herein embodied, inner guidemembers 64 are mounted on surface 60 of cylindrical portion 54 and are radially spaced from and axially extending a predetermined distance parallel to the central axis 62 of surface 60. Outer surfaces 66 of inner guidemembers 64 lie on a periphery of a circle (FIG. 4), having a diameter equal to the inner diameter of the inner perimetrical edge 16 of the diaphragm members 12 and being concentric to the central axis 62, and abut the inner perimetrical edge 16 of each diaphragm member 12 and the inner perimetrical edge 30 of each inner washer 26 stacked onto surface 60 of cylindrical portion 54, urging all of the stacked diaphragm members 12 and inner washers 26 into alignment coaxial with central axis 62 of surface 60. Outer guidemembers 68 are a pair of removable semi-circular cylindrical sleeves disposed on surface 58, with a portion of the radially inner surface 70 of each outer guidemember 68 being positioned adjacent peripheral surface 56 of cylindrical portion 54. Inner surfaces 70 engage the outer perimetrical edges 22 of diaphragm members 12 and the outer perimetrical edges 32 of outer washers 28, urging all of the stacked diaphragm members 12 and outer washers 28 into alignment coaxial with central axis 62 of surface 60. Accordingly, all diaphragm members 12 and washers 26, 28 are coaxially aligned in fixture 50.

In accordance with the present invention, the apparatus comprises means for axially compressing the stacked and coaxially aligned diaphragm members and brazing material members for providing intimate contact therebetween and for maintaining the members in the stacked and coaxially aligned position. As herein embodied, the means for axially compressing comprises a shaft 72 coaxially mounted on surface 60 and a compressing member 74 slidably disposed via opening 75 on shaft 72 for engaging an extreme outer member of the stacked diaphragm members 12. By applying a force in the axial downward direction, referring to FIG. 3, compressing member 74 is spaced a selected axial distance from surface 60 for compressing the stacked diaphragm members 12 and washers 26, 28 by an amount which is sufficient to position them in intimate contact to permit controlled brazing without undesirable superfluous wicking of brazing filler material from the joints of bellows core 10 by capillary attraction (typically, to interior of bellows core 10), and also to secure the bellows assembly mounted in fixture 50 against dislocation during brazing and as a result of subsequent handling. Preferably, compressing member 74 is circular and has an outer diameter no greater than the outer diameter of diaphragm members 12, to permit sufficiently uniform distribution of the compressing load applied to the stack, but without contacting the outer guidemembers 68. Compressing member 74 may be secured in position, compressing the stack, by means of a retainer ring or collar 76 mounted on shaft 72, for example.

As embodied herein, inner guidemembers 64 are inserted into fixture 50, into position for aligning the diaphragm members 12 and washers 26, 28, via openings 78 in planar member 52 and extend a predetermined distance above surface 60, as limited by the abutment of stops 80 positioned at the end of inner guidemembers 62 with the bottom surface 82 of the planar member 52. Outer guidemembers 68 are held in position adjacent peripheral surface 68 by annular ring 84.

In accordance with the present invention, the method further includes heating the diaphragm members and the brazing material to braze and join together the pairs of adjacent flange portions. As embodied herein, the stacked, coaxially aligned and compressed diaphragm members 12 and washers 26, 28 in apparatus 50 are subjected to furnace heat sufficient to braze the pairs of facing planar surfaces 18*a*, 18*b* and 20*a*, 20*b* of adjacent diaphragms 12, respectively, with the corresponding interposed washers 26, 28. In preparation for placing apparatus 50 in the furnace for brazing, it is desirable to remove unnecessary heat sinks such as inner guidemembers 62 and outer guidemembers 68 from their respective positions in fixture 50. Inner guidemembers 64 are removable from the interior of the stacked plurality by withdrawing them through openings 78 in planar member 52. Guidemembers 68 are then removed radially after removing annular ring 84. Thus, the adjacent flanges 18, 20 and corresponding interposed washers 26, 28 are exposed to the brazing environment without disturbing their precise alignment. Other means including a removable sleeve (not shown) concentric to inner guidemembers 62 for aligning the stack, for example, may be provided and removed from the top of the fixture via penetrations (not shown) formed in compressing member 52.

As embodied herein, apparatus 50 with inner and outer guidemembers 64, 68 removed is placed in a brazing furnace for brazing with the central axis 62 of surface 60 in a vertical position and flanges 18, 20 horizontal to permit uniform wetting of the brazing filler material and to prevent undesirable superfluous wicking of the brazing filler material from between the pairs of adjacent flanges 18, 20. The pairs of adjacent flanges 18, 20 and corresponding interposed washers 26, 28 are brazed substantially simultaneously in the furnace, and preferably in a vacuum. Following brazing, the brazed plurality of diaphragm members 12 is annealed, quenched by cooling and tempered by heating.

Preferably, the dimensions of the flange portions 18, 20, the washers 26, 28, the configuration and dimensions of the annulus portion 24, the brazing temperature and the time-at-temperature are selected to provide a strong, uniform brazed joint, and to prevent undesirable wicking of the brazing filler metal from the joints during brazing.

Preferably, in order to eliminate the necessity of a separate additional heat treatment step, the brazing filler metal of washers 26, 28 is selected to have a melting point substantially equal to the annealing temperature of the base metal of diaphragm members 12, and the brazing and annealing steps are performed substantially simultaneously, prior to quenching and tempering.

In summary, in fabricating the metal bellows core of the present invention from method and apparatus provided, the formed diaphragm members 12 and the inner and outer washers 26, 28 of brazing filler material, members 12 and washers 26, 28 are positioned in apparatus 50 in stacked formation with alternating pairs of adjacent inner flange portions 18 and adjacent out flange portions 20. Stacked members 12 and washers 26, 28 are then coaxially aligned with inner and outer guidemembers 64, 68 in position in apparatus 50. Compressing member 74 is mounted on shaft 58 to engage the adjacent stacked diaphragm member 12 and an axially downward force is applied to compress the stack into contact for brazing. Inner and outer guidemembers 64, 68 are then removed from apparatus 50, and apparatus 50 is placed in a furnace for brazing the stacked members 12 and washers 26, 28 to form a brazed bellows core such as bellows core 10.

In an actual reduction to practice of the present method, including use of the presently described brazing apparatus, the above described bellows core of AM-350 diaphragms and silver-copper brazing alloy was fabricated by brazing to stacked plurality of diaphragm members and washers (including end fittings) in a vacuum in a furnace. The brazing and annealing steps were performed simultaneously at a temperature of 1700° F., prior to tempering, thus eliminating the need for an additional heat treatment at 1700° F. Following brazing, the brazed bellows core was subsequently leak-checked with helium, quenched at minus 100° F., and tempered at 900° F. prior to fatigue testing.

It will be apparent to those skilled in the art that various modifications, variations and additions can be made in the present invention without departing from the spirit or scope of the present invention. Thus, it is intended that the present invention cover the modifications and variations provided they come within the general scope of the claims and their equivalents.

What is claimed is:

1. An apparatus for fabricating a brazed metal bellows core from a plurality of resilient annular metal diaphragm members and a plurality of annular brazing filler material members for brazing the diaphragm members together, comprising:

means for positioning the diaphragm members and brazing material members in a stacked formation with the brazing material members interposed between adjacent diaphragm members, said means for positioning including a planar member having a cylindrical portion forming a peripheral surface for defining an inner circular boundary of a first supporting surface, said cylindrical portion having a planar second supporting surface parallel to the plane of the planar member and having a central axis and an outer diameter equal to the outer diameter of the diaphragm members, said second supporting surface for supporting in position thereon a stacked formation of diaphragm members and brazing material members;

means for coaxially aligning the stacked diaphragm members and brazing material members; and means for axially compressing the stacked and coaxing aligned diaphragm members and brazing material members for providing intimate contact therebetween and for maintaining the members in the stacked and coaxially aligned position during brazing.

2. The apparatus claimed in claim 1, wherein the means for axially compressing comprises a shaft coaxially mounted on said second supporting surface and a compressing member slidably disposed on said shaft for engaging an outer member of the stacked diaphragm members.

3. The apparatus claimed in claim 2, wherein the compressing member is spaced a selected axial distance from the second supporting surface, said compressing member being circular and having a diameter no greater than the outer diameter of the diaphragm members, and a central opening therein for mounting on said shaft.

4. An apparatus for fabricating a brazed metal bellows core from a plurality of resilient annular metal diaphragm members and a plurality of annular brazing filler material members for brazing the diaphragm members together, comprising:

means for positioning the diaphragm members and brazing material members in a stacked formation with the brazing material members interposed between adjacent diaphragm members;

means for coaxially aligning the stacked diaphragm members and brazing material members, said means for coaxially aligning including outer guide members and inner guidemembers, said inner guidemembers mounted on the means for positioning the diaphragm members and radially spaced from and parallel to the central axis of the means for positioning the diaphragm members, the outer surface of said plurality of inner guidemembers lying on a periphery of a circle having a diameter substantially equal to the inner diameter of the diaphragm members, said outer guidemembers being a pair of removable semi-circular cylindrical sleeves disposed on said means for positioning the diaphragm member, a portion of the radially inner surface of said sleeve corresponding to and in engagement with the peripheral surface of the cylindrical portion, said inner sleeve surface for engaging the outer perimetrical edges of the stacked diaphragm members and brazing material members for coaxially aligning the members;

means for axially compressing the stacked and coaxing aligned diaphragm members and brazing material members for providing intimate contact therebetween and for maintaining the members in the stacked and coaxially aligned position during brazing.

5. The apparatus claimed in claim 4, wherein the inner guide members are removably disposed in the means for positioning the diaphragm members.

* * * * *

UNITED STATES PATENT AND TRADEMARK OFFICE

CERTIFICATE OF CORRECTION

PATENT NO. : 4,924,756

DATED : March 15, 1990

INVENTOR(S) : Donald N. Berube et al.

It is certified that error appears in the above-identified patent and that said Letters Patent is hereby corrected as shown below:

Claim 1, column 8, lines-28-29, change "coaxing" to --coaxially--.

Claim 4, column 9, lines 8-9, change "coaxing" to --coaxially--.

Signed and Sealed this

Twenty-third Day of July, 1991

*Attest:*

HARRY F. MANBECK, JR.

*Attesting Officer*

*Commissioner of Patents and Trademarks*